US006881023B1

(12) United States Patent
Sullivan

(10) Patent No.: US 6,881,023 B1
(45) Date of Patent: Apr. 19, 2005

(54) PALLET FORK CARRIAGE WITH A LOAD SECURING D-RING AND METHOD OF USING

(75) Inventor: Marty Sullivan, Schofield, WI (US)

(73) Assignee: Attachment Technologies, Inc., Delhi, IA (US)

( * ) Notice: Subject to any disclaimer, the term of this patent is extended or adjusted under 35 U.S.C. 154(b) by 0 days.

(21) Appl. No.: 10/605,864

(22) Filed: Oct. 31, 2003

(51) Int. Cl.[7] ..... B66F 9/18
(52) U.S. Cl. ..... 414/607; 187/237
(58) Field of Search ..... 414/607, 448, 414/449, 685, 724; 187/237; 248/499; 24/265 CD, 24/115 K; 410/97, 106, 107, 110, 111, 116, 410/50, 51, 45, 47

(56) References Cited

U.S. PATENT DOCUMENTS

| | | | | |
|---|---|---|---|---|
| 1,254,778 | A * | 1/1918 | Comfort | 414/448 |
| 4,090,628 | A | 5/1978 | Sinclair | |
| 4,354,795 | A | 10/1982 | Dutra, Jr. | |
| 4,538,953 | A | 9/1985 | Abramson, Jr. | |
| 4,756,651 | A | 7/1988 | Van Gompel et al. | |
| 5,052,869 | A * | 10/1991 | Hansen, II | 410/111 |
| 5,374,155 | A * | 12/1994 | Van Baale et al. | 414/607 |
| 5,562,397 | A | 10/1996 | Albright | |
| 6,015,255 | A | 1/2000 | Vander Meer | |
| 6,213,696 | B1 * | 4/2001 | Austin | 410/106 |

* cited by examiner

*Primary Examiner*—Donald W. Underwood
(74) *Attorney, Agent, or Firm*—Ryan N. Carter

(57) ABSTRACT

The present invention is a skid-steer attachment device with a load bearing D-ring for securing loads to the attachment device. A number of different attachment devices can be attached to a skid-steer loader, however, the preferred attachment device in this invention is a pallet fork carriage. The load securing D-ring is attached to the pallet fork carriage of the skid-steer so that loads can be secured to the D-ring by tying, strapping, or otherwise attaching the load to the D-ring. The D-ring on the pallet fork carriage functions to prevent a skid-steer loader's load from becoming dislodged prematurely.

2 Claims, 3 Drawing Sheets

PALLET FORK CARRIAGE WITH A LOAD SECURING D-RING AND METHOD OF USING

BACKGROUND OF INVENTION

The present invention relates to the safe movement of materials. More particularly, the present invention relates to securing loads onto lift-truck vehicles.

Lift trucks such as forklifts or skid-steer vehicles are common machines for moving heavy loads. They are often used in a warehouse or other industrial setting in which speed and efficiency are required. This need for quick movement of loads often results in the lift truck operator driving at a high rate of speed. At high rates of speed and during quick stops, the load on a lift truck can shift or fall. This can present a dangerous situation to people around the lift truck, as well as damage to the materials on the load. The potential danger of a lift truck load falling is compounded by the fact that in the interest of efficiency, loads are often stacked onto pallets. These stacks can become very high, which increases the likelihood of the load shifting or falling off completely. If a load were to fall off a lift truck under any conditions it could be seriously harmful, and even deadly.

There have been several prior art devices that have attempted to solve this problem. One method used in the prior art to stabilize loads employs a clamping means in which long stabilizing arms extend outward and clamp around a load. U.S. Pat. No. 4,354,795 discloses a clamping means in which the clamping means comprises a downwardly facing load engaging surface. U.S. Pat. No. 4,090,628 discloses a clamping means in which the arms engage the sides of the load. The problem with these clamping devices is that the clamping arms are long and straight, and thus they are only effective if the load is comprised of a long straight surface. These clamping devices also require additional expensive hydraulics and/or mechanics to move the clamping arms toward and away from the load.

Yet another prior art method used to stabilize loads on skid-steers is disclosed in U.S. Pat. No. 4,538,953. This patent discloses a gravity operated latch that is vertically engaged when the pallet fork of the skid-steer is lifted off of the ground. As the pallet fork is lifted from the ground, the latch is lowered by gravity until is catches on a hook or handle located on the load. When the pallet fork is lowered to the ground again, the latch's lower portion contacts the ground, which pushes the latch away from the hook or handle located on the load. The problem with this device is the latching mechanism is useless if the load does not have a hook or handle in the proper position, or if the load is of an obscure shape.

There is therefore a need for a device that will secure a load to a pallet fork of a lift truck and support the weight of that load, even if the load shifts on the pallet fork and/or if the load is of an obscure shape.

It is therefore an object of the present invention to provide a simple and cost effective device for safely and efficiently transporting loads on pallet forks.

It is another object of the present invention to provide a device for safely and efficiently transporting loads on pallet forks when the loads are of an obscure shape.

SUMMARY OF INVENTION

The present invention combines a load securing D-ring with the pallet fork carriage attachment of a lift truck such as a forklift or skid-steer loader. The D-ring is securely combined with the pallet fork carriage and is made of a sturdy material so that it is strong enough to support a heavy load. The load on the pallet forks are tied, strapped, or otherwise fastened to the D-ring so that it will not slide off of the pallet fork in the event the skid-steer makes a sharp turn or in the event the load is of an obscure or round shape. If the load is secured to the D-ring yet manages to slide off the pallet forks, the load will only fall the length of the strap and will not fall to the ground and injure anyone or damage the load. The device of the present invention can also provide a craning effect. A craning effect is accomplished when the D-ring assists the skid-steer loader in acting as a crane by fastening loads to the D-ring without resting the load on the forks. Using this method, the skid-steer can lift and carry heavy objects fastened to the D-ring without having to position them on the pallet forks.

The device of the present invention provides significant advantages over merely attaching a load to an already existing area of a fork lift attachment (such as a cross bar) because the D-ring of the present invention is designed to be load bearing, while other areas of a forklift may not be so designed. The D-ring of the present invention is also combined with the fork lift carriage attachment at a place where a significant load will minimally affect the stability of the fork lift truck. Whereas, if a load is fastened too high on the attachment, or is fastened to one side of the attachment or the other, the center of gravity of the fork lift truck may be negatively affected causing the fork lift truck to tip over.

DETAILED DESCRIPTION

Figure 1:
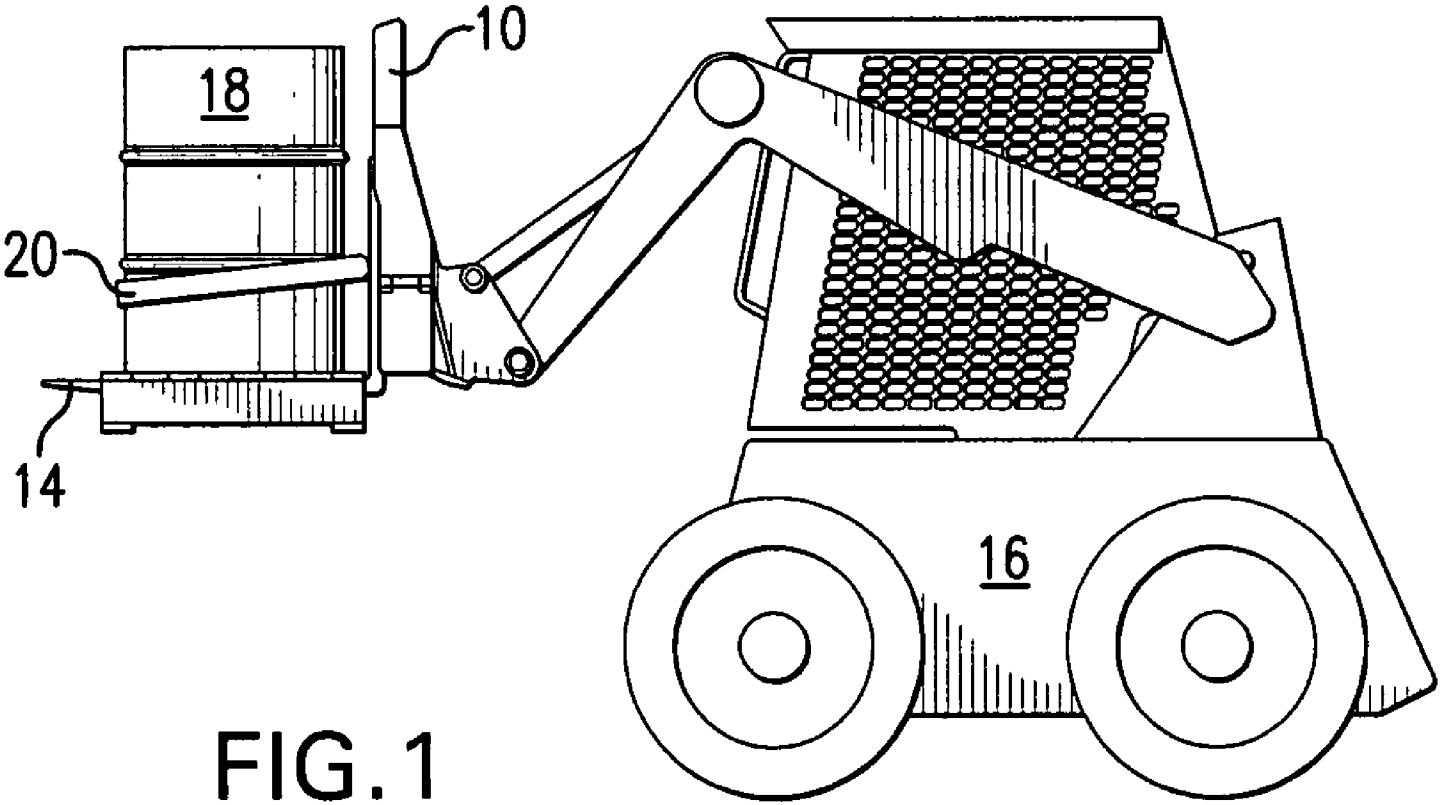
FIG. 1 is a perspective view of a skid-steer loader carrying a load that is strapped to the D-ring of the pallet fork attachment.

In FIG. 1 there is shown a lift truck such as a skid-steer loader generally designated by the reference numeral 16. Combined with the skid-steer loader 16 is an attachment such as a pallet fork carriage 10 which comprises several forks 14 protruding outwardly therefrom. It is well known in the art that this configuration of skid-steer loader 16 and pallet fork carriage attachment 10 is capable of lifting and carrying heavy loads. The present invention combines at least one D-ring 12 onto any suitable skid-steer loader attachment, with the preferred attachment being a pallet fork carriage 10 attachment.

Figure 2:
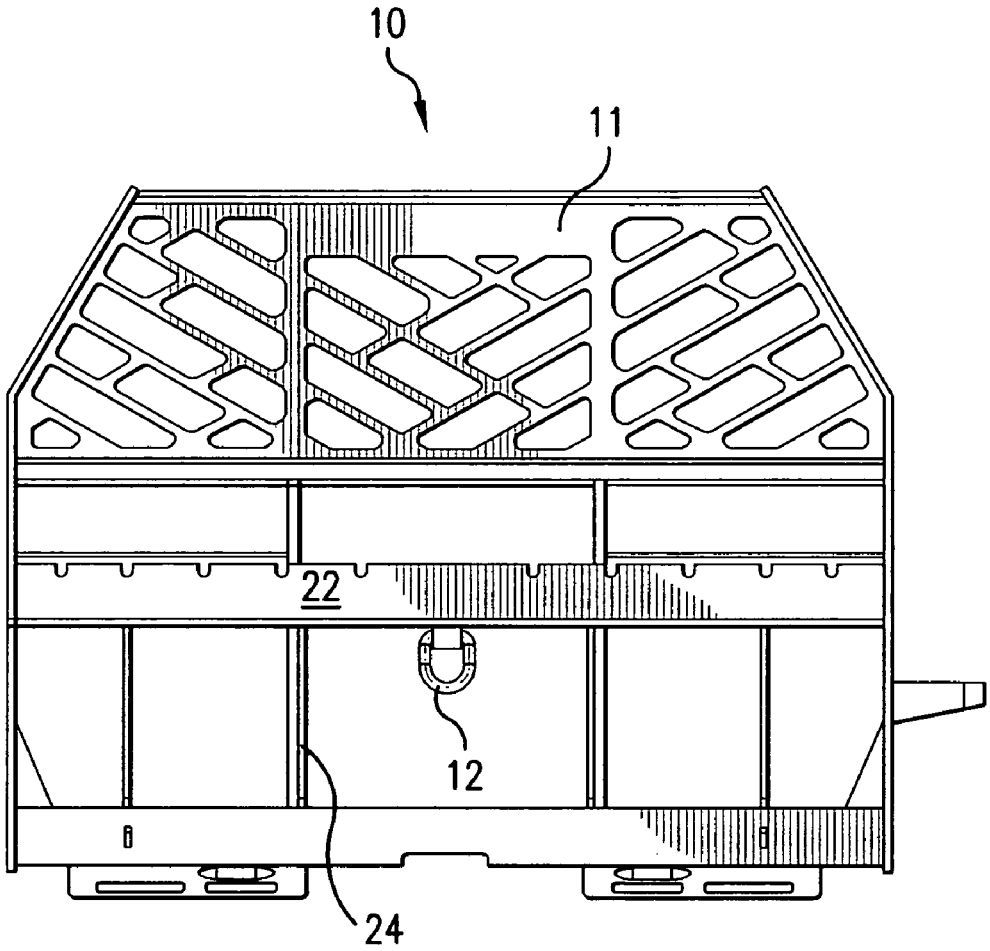
FIG. 2 is a front view of the pallet fork carriage attachment showing the D-ring attached to the cross bar.
Figure 3:
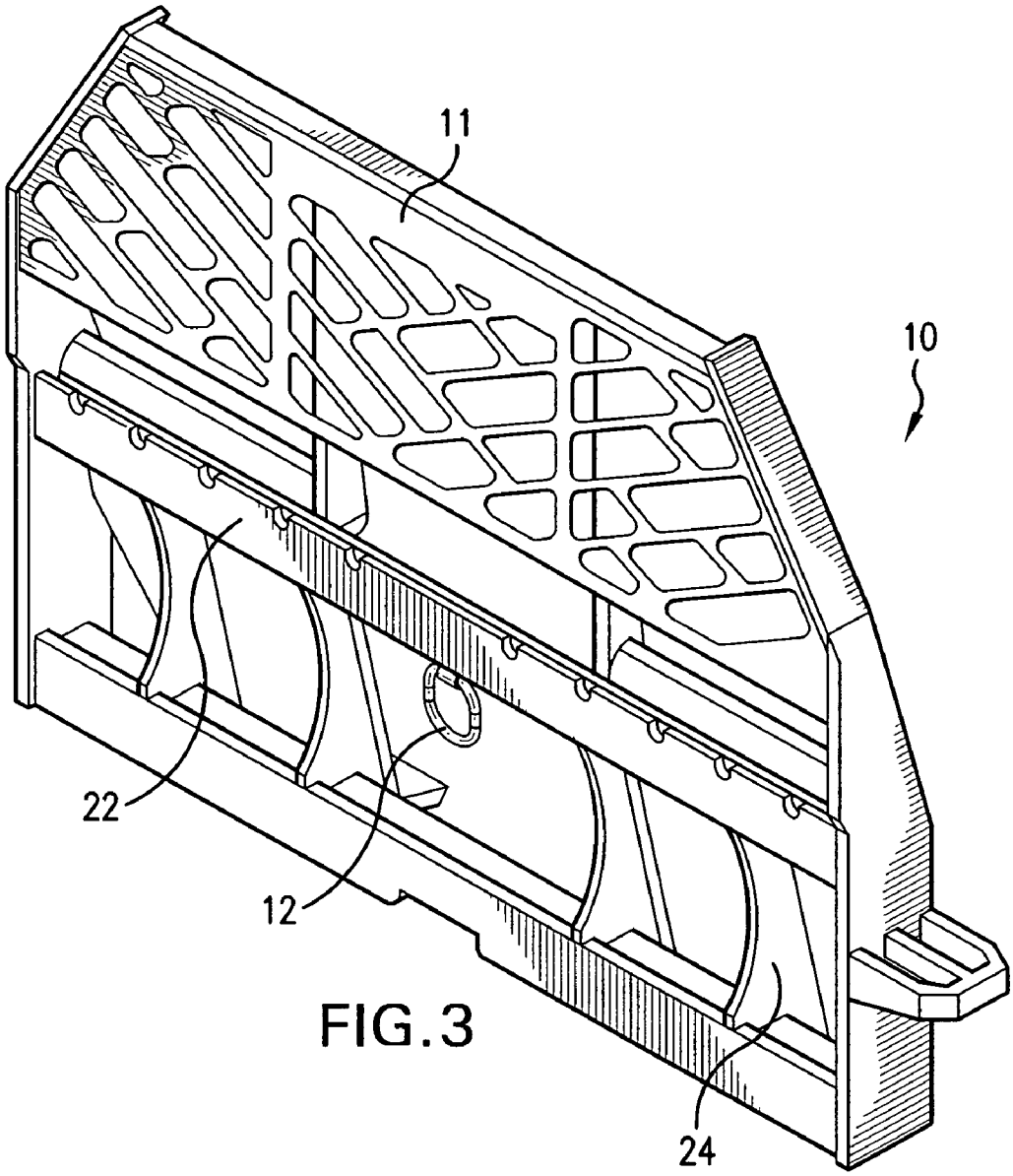
FIG. 3 is a perspective view of the pallet fork carriage attachment showing the D-ring attached under the cross bar.

As seen in FIGS. 2 and 3, the pallet fork carriage 10 is generally comprised of a main support plate 11 below which are one or more horizontal cross bars 22 joined by a plurality of vertical members 24. The D-ring 12 is preferably combined with the pallet fork carriage 10 by being pivotally mounted directly beneath the centralized horizontal cross bar 22. This allows the D-ring 12 to be free swinging and pivot on the axis from which it hangs. This provides convenience in threading ties through the D-ring 12 and also provides some adjustability of the D-ring 12. The location of the D-ring 12 under a horizontal cross bar 22 also keeps the D-ring out of the way of the load 18 by allowing the load 18 to rest flush against the pallet fork carriage 10.

FIG. 1 shows how the D-ring 12 is used for securing loads 18 to the pallet fork carriage 10. A tie 20 such as a strap, rope, or cable is used to secure the load 18 to the D-ring 12. The tie 20 can be secured around the load 18, or through the load 18 if the load 18 provides a suitable opening through which a tie 20 can be threaded. This securing of the load 18 to the pallet fork carriage 10 through the D-ring 12 prevents the load 18 from becoming dislodged or otherwise falling off of the pallet fork 10 during lifting and transport operations. If the load 18 is tied to the D-ring 12 and the load 18 does fall off of the pallet forks 14, the load 18 will only fall the length of the tie 20. This prevents injury to people and materials that may be located below the falling load 18, as well as preventing damage the load 18 itself.

The D-ring 12 on the pallet fork carriage 10 can also provide a craning effect for the skid-steer loader 16. Using this craning method, the load 18 is securely tied to the D-ring 12 with a tie 20 such as a strap, rope, cable, or chain. The pallet fork carriage 10 is then lifted off of the ground using the hydraulics of the skid-steer which forces the D-ring 12 to lift the load 18 off the ground. The load 18 becomes hoisted and/or transported, and then lowered and detached from the D-ring 12. This craning effect is advantageous when a load 18 is of an obscure shape, or when it would not otherwise easily fit onto the pallet fork 10. The craning effect is also beneficial when a load 18 or other object is not easily accessible by the pallet forks 14, such as when an object buried partially underground (a pipe for example) needs to be raised to the surface.

In its general operation, the D-ring 12 on the pallet fork carriage 10 of the present invention provides a quick and efficient method of securing loads 18 to pallet forks 14. This remains true even if the load 18 is of an obscure shape which a pallet fork 14 attachment may not normally be able to transport. For example, heavy objects that are too small to fit onto the forks 14 of the pallet fork carriage 10 attachment may normally be too dangerous to transport or hoist. However, if the object can be secured to the palled fork carriage 10 with the D-ring 12, the object can be safely transported.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A cargo securing device for securing a load of cargo to a lift truck, said device comprising:

a pallet fork carriage assembly with forks adapted for attachment to the lift truck;

at least one load securing D-ring securely affixed to the pallet fork carriage;

wherein the pallet fork carriage has at least one structural horizontal cross member having a top side and a bottom side; and wherein the D-ring is attached to the cross member bottom side.

2. A cargo securing device for securing a load of cargo to a lift truck, said device comprising:

a pallet fork carriage assembly with forks adapted for attachment to the lift truck;

at least one load securing D-ring securely affixed to the pallet fork carriage;

wherein the pallet fork carriage has at least one structural horizontal cross member having a top side and a bottom side;

wherein the D-ring is attached to the cross member bottom side; and wherein the D-ring is pivotally mounted so as to be free swinging at its attachment point under the cross member.

* * * * *